US005210403A

United States Patent [19]

Nakamura et al.

[11] Patent Number: 5,210,403

[45] Date of Patent: May 11, 1993

[54] RADIATION DETECTING DEVICE WITH A PHOTOCATHODE BEING INCLINED TO A LIGHT INCIDENT SURFACE

[75] Inventors: Kimitsugu Nakamura; Masuo Ito; Seiji Suzuki; Yasushi Watase, all of Hamamatsu, Japan

[73] Assignee: Hamamatsu Photonics K.K., Hamamatsu, Japan

[21] Appl. No.: 887,131

[22] Filed: May 22, 1992

[30] Foreign Application Priority Data

May 22, 1991 [JP] Japan ..... 3-117563
Mar. 19, 1992 [JP] Japan ..... 4-063831

[51] Int. Cl.[5] ..... H01J 40/14

[52] U.S. Cl. ..... 250/214.1; 250/207; 313/544

[58] Field of Search ..... 250/211 R, 207, 213 VT; 313/532, 533, 534, 536, 528, 530, 541, 544, 104, 103 R

[56] References Cited

U.S. PATENT DOCUMENTS 3,513,345 5/1970 Feaster .
3,688,145 8/1972 Coles .
3,885,173 5/1975 Goehner .
4,623,785 11/1986 L'hermite ..... 250/207
4,987,336 1/1991 L'Hermite et al. ..... 313/104
5,126,629 6/1992 Chopy ..... 313/533

FOREIGN PATENT DOCUMENTS 59-226454 12/1984 Japan .

OTHER PUBLICATIONS

Patent Abstracts of Japan, Appln. No. JP830096379, Appln. Date Mar. 31, 1983 "Photomultiplier Tube".
Patent Abstracts of Japan, Appln. No. JP830096380, Appln. Date Mar. 31, 1983 "Photomultiplier Tube to be Used Under Existence of Magnetic Field".

*Primary Examiner*—David C. Nelms
*Assistant Examiner*—Que T. Le
*Attorney, Agent, or Firm*—Cushman, Darby & Cushman

[57] ABSTRACT

There is disclosed a phototube comprising a closed container having a light permeable face plate the outside surface of which is a light incident surface, a photocathode so provided in the closed container that at least a part of a photo-electric surface is inclined to the light incident surface, and an anode so provided in the closed container that an electron capturing surface is opposed to the photo-electric surface in parallelism therewith.

17 Claims, 15 Drawing Sheets

RADIATION DETECTING DEVICE WITH A PHOTOCATHODE BEING INCLINED TO A LIGHT INCIDENT SURFACE

BACKGROUND OF THE INVENTION

1. Field of the Invention

This invention relates to a phototube which is operative even in a strong magnetic field and to a radiation detecting device using the phototube, specifically to those which are used in the field of high energy physics.

2. Related Background Art

Conventionally the phototube of this kind has the structure of FIG. 1. A photocathode 2 is formed on the inside surface opposed to the light incident surface 1*a* of a glass container 1. A beam of light from the light incident surface 1*a* is converted into photoelectrons by the photocathode 2. The converted photoelectrons are attracted to an anode 3 opposed to the photocathode 2 by an electric field E to be captured by the anode 3.

Some of the phototubes having the photoelectron multiplying function, i.e., including photoelectron multipliers, have the structure of FIG. 2. A photocathode 52 is formed on the inside surface opposed to the light incident surface 51*a* of a glass container 51. A beam of light from the light incident surface 51*a* is converted into photoelectrons by the photocathode 52. The converted photoelectrons are attracted to an anode 53 opposed to the photocathode 52 by an electric field E. A dynode 53 is made up with a plurality of electrodes 53*a, b*, . . . and emits in secondary electrons the photoelectrons it received. The emitted secondary electrons are finally captured by an anode 54.

But in the above-described conventional phototube 4, if a strong magnetic field B is absent in the direction normal to the electric field E and in the vertical direction in the drawing, in other words, the direction parallel with the light incident surface 1*a*, although it depends on a voltage applied between the photocathode 2 and the anode 3, there will occur the phenomenon that the photoelectrons emitted by the photocathode 2 cannot be captured by the anode 3. That is, because of the strong magnetic field B, the photoelectrons emitted by the photocathode 2 have a cycloidal motion, a circular motion returning to the photocathode 2 as indicated by the arrow. Consequently the photodetecting efficiency is sometimes lowered because of the strong magnetic field B normal to the electric field E.

This phenomenon is true also with the above-described conventional photoelectron multiplying tube 55. That is, if a strong magnetic field B is present in the direction parallel with the light incident surface 51*a* of the glass container 51, although it depends on a voltage applied between the photocathode 52 and the electrodes 53*a, b*, . . . of the dynode 53*a*, the photoelectrons emitted by the photocathode 52 cannot be captured by the dynode 53*a*. In other words, similarly with the above-described phototube, the photoelectrons emitted by the photocathode 52 have a cycloidal motion, a circular motion returning to the photocathode 52 as indicated by the arrow. This phenomenon takes place also at the part of the dynode 53 which multiplies the electrons. Consequently the photodetecting efficiency of the photoelectron multiplying tube 55 is sometimes lowered because of the strong magnetic field B normal to the electric field E.

FIG. 3 is a diagrammatic view of the cycloidal motion of photoelectrons in the above-described phototubes. The track of the photoelectrons is depicted by the dot line. For example, when a strength of the magnetic field B is 0.6 [T], an initial velocity of the emitted photoelectrons is 0 [eV], an applied voltage between the photocathode 2 and the anode 3 or between the photocathode 52 and the dynode 53*a* is 1000 [V], the photoelectrons are spaced by 0.177 [mm] at maximum ($=y_{max}$) from the photocathode 2 or 52 because of the cycloidal motion. Accordingly under these set conditions, if the photocathode 2 and the anode 3 or between the photocathode 52 and the dynode 53*a* are spaced from each other by more than 0.177 [mm], the photoelectrons emitted by the photocathode 2 or 52 cannot arrive at the anode 3 or the dynode 53*a*. In the photoelectron multiplying tube 55, such influence of the strong magnetic field B range not only between the photocathode 52 and the dynode 53*a*, but also to the electron multiplication of the dynode 53*a*.

To solve this problem, the phototube 4 or the photoelectron multiplying tube 55 itself is so moved or turned in accordance with a direction of the magnetic field B known beforehand that the magnetic field B is normal to the light incident surface 1*a* or 51*a*. This is because when the electric filed E and the magnetic field B are parallel with each other, the photoelectrons do not have a cycloidal motion, and resultantly the photodetecting efficiency of the phototube 4 and the photoelectron multiplying tube 55 is not lowered.

But in the high energy particles (radiation) detecting devices using such phototube 4 or photoelectron multiplying tube 55, as described above it is generally difficult to optimumly change positions and directions of the phototube 4 or the photoelectron multiplying tube 55. That is, such radiation detecting device usually has a section of FIG. 4. A plurality of scintillators 5 of $BaF_2$ for detecting radiation are arranged so as to enclose the detecting portion for a light beam to pass through, and the photocathode 4 or the photoelectron multiplying tube for photoelectrically converting detected radiation is fixed to the back of each of the scintillators. Accordingly the position of the photocathode 4 or the photoelectron multiplying tube 55 itself is restricted by its connection to the output terminal of each of the scintillators 5 and cannot be optionally changed. Consequently to position the photocathode 4 or the photoelectron multiplying tube 55 so that the magnetic field B is normal to the light incident surface 1*a* or 51*a* of the glass container 1 or 51, it is not necessary to machine the scintillators 5 in a rod shape but to machine them 5 so that the output terminals form a required angle. Generally, however, it is difficult to machine scintillators. Consequently it is actually impossible to agree a direction of the electric field E generated between the photocathode 2 and the anode 3 or between the photocathode 52 and the dynode 53*a* with a direction of the magnetic field B.

SUMMARY OF THE INVENTION

The phototube according to this invention has been made to solve the above-described problems, and to this end comprises a photocathode inclined to a light incident surface of a light permeable closed container, and an anode opposed to the inclined photocathode.

The phototube according to this invention has a photoelectron multiplying function, and comprises a photocathode inclined to a light incident surface of a light permeable closed container, an electrode for emitting secondary electrons, and an anode opposed to the electrode.

The phototube according to this invention has a photoelectron multiplying function, and comprises a solid-state semiconductor device, in place of the electrode for emitting secondary electrons, for internally multiplying photoelectrons emitted by a photocathode, and a photocathode inclined to a light incident surface of a closed container, the solid-state semiconductor device being opposed to the photocathode.

A radiation detecting device according to this invention comprises a scintillator for emitting light upon detecting radiation, and any one of the above-described photocathodes for receiving the light emitted by the scintillator and emitting photoelectrons.

In the phototube according to this invention, even if a magnetic field is applied in parallelism with the light incident surface of the light permeable closed container, the photoelectrons emitted by the photocathode move along a direction of the magnetic field to reach the anode because of a component of the electric field E along the direction of the magnetic field when the direction of the magnetic field forms an angle to the photo-electric surface with the photocathode formed on because the photocathode and the anode are inclined to the light incident surface.

In the phototube having a function of secondarily multiplying photoelectrons, even if a magnetic field is applied in parallelism with the light incident surface of the light permeable closed container, the photoelectrons emitted by the photocathode move along a direction of the magnetic field because of a component of the electric field along the direction of the magnetic field to reach the electrons for emitting the secondary electrons when the direction of the magnetic field forms an angle to the photo-electric surface with the photocathode formed on, because the photocathode and the electrode for emitting the secondary electrons are inclined to the light incident surface. The secondary electrons as well move along the direction of the magnetic field to be captured by the anode opposed to the electrode.

In the phototube for multiplying photoelectrons internally in the solid-state semiconductor device, even if a magnetic field is applied in parallelism with the light incident surface of the light permeable closed container, the photoelectrons emitted by the photocathode move along a direction of the magnetic field to reach the solid-state semiconductor device because of a component of the electric field along the direction of the magnetic field when the direction of the magnetic field forms an angle to the photo-electric surface with the photocathode formed on, because the photocathode and the slid semiconductor device are inclined to the light incident surface. Within the solid-state semiconductor device the incident photoelectrons are multiplied without any influence of the external magnetic field.

When the magnetic field has no angle to the photoelectric surface, the photocathode itself is merely turned so that the direction of the magnetic field forms an angle to the photo-electric surface. Consequently, similarly with the above, the photoelectrons emitted by the photocathode move along the direction of the magnetic field because of a component of the electric field along the magnetic field to reach the anode, the electrode for emitting the secondary electrons or the solid-state semiconductor device.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

BRIEF DESCRIPTION OF THE DRAWINGS

FIG. 18 is a sectional view of the secondary electron multiplying portion of FIG. 17 with an external magnetic field B applied to;

DETAILED DESCRIPTION OF THE PREFERRED EMBODIMENTS

Figure 5A:
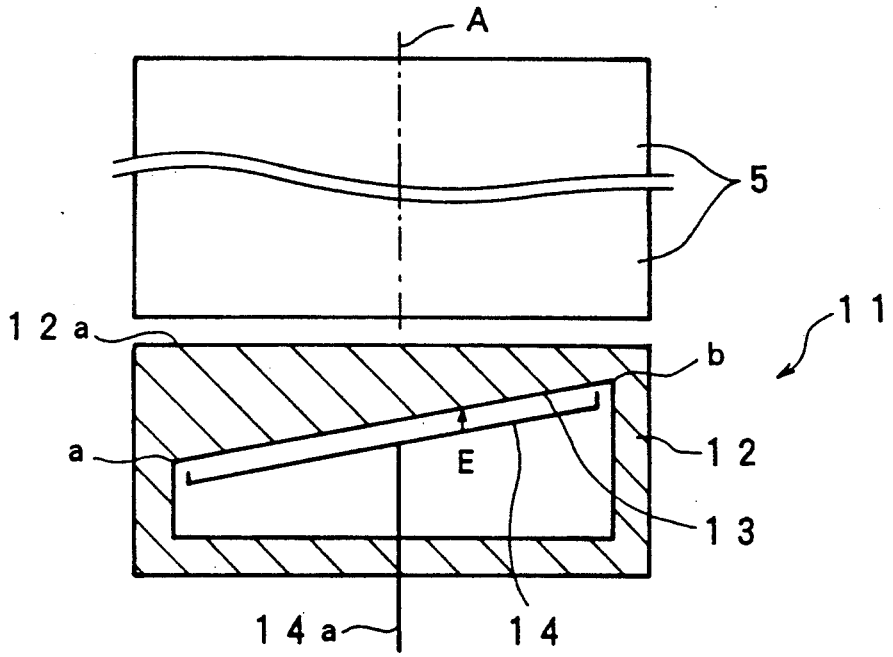
FIGS. 5A and 5B are sectional views of the phototube according to a first embodiment of this invention showing its structure.
Figure 5B:
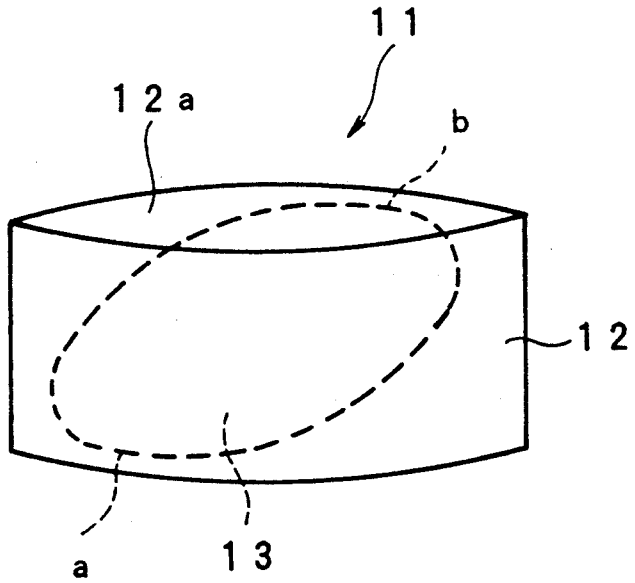

FIG. 5A is a sectional view of the phototube according to a first embodiment of this invention, and FIG. 5B is a perspective view of this phototube.

A phototube 11 is housed in a cylindrical glass bulb 12. The top surface and the bottom surface of the glass bulb are air-tightly closed and has the interior maintained vacuum. The glass bulb 12 is made of a transparent material, and the top surface, i.e., the outside of the top plate, i.e., the face plate of the bulb 12, is the light incident surface 12*a*. Thus a light permeable closed container is provided. The top plate, i.e., the face plate of this closed container must be light permeable, but the bottom plate and the side surfaces may be light shielding. In this glass bulb 12 there are provided a photocathode 13 for emitting photoelectrons upon receiving a beam of light, and an anode 14 for capturing the photoelectrons emitted by the photocathode 13. The photocathode 13 which constitutes the photo-electric surface is provided on the inside surface (the inside of the face plate) of the glass bulb 12, which (the inside surface) is inclined at an angle to the light incident surface 12*a* thereof. The photo-electric surface with the photocathode 13 formed on is indicated by the dot line in the perspective view of FIG. 5B. The end a of this photoelectric surface is most distant from the light incident surface 12*a*, and the end b thereof is nearest to the light incident surface 12*a*. An anode 14 is provided in parallelism with the photocathode 13 and has a lead 14*a* electrically connected to the outside. The anode 14 is near enough to the photocathode 13 to necessitate no electrostatic focusing.

In this structure, a beam of light from the light incident surface 12*a* impinges on the photocathode 13 and is converted there to photoelectrons. The emitted photoelectrons are attracted to the anode 14 because of the electric field E formed between the photocathode 13 and the anode 14 to finally impinge on the electron capturing surface of the anode 14 and captured by the anode 14.

In the device of FIG. 5A, a scintillator 5 is provided opposed to and near (or on) the light incident surface 12*a* rotatably on the central axis A.

Figure 1:
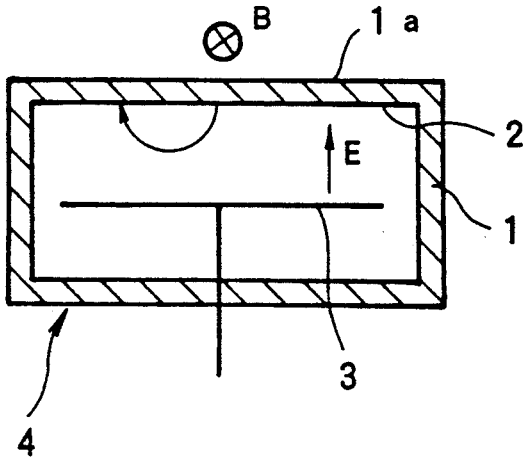
FIG. 1 is a sectional view of the conventional phototube showing its structure.
Figure 2:
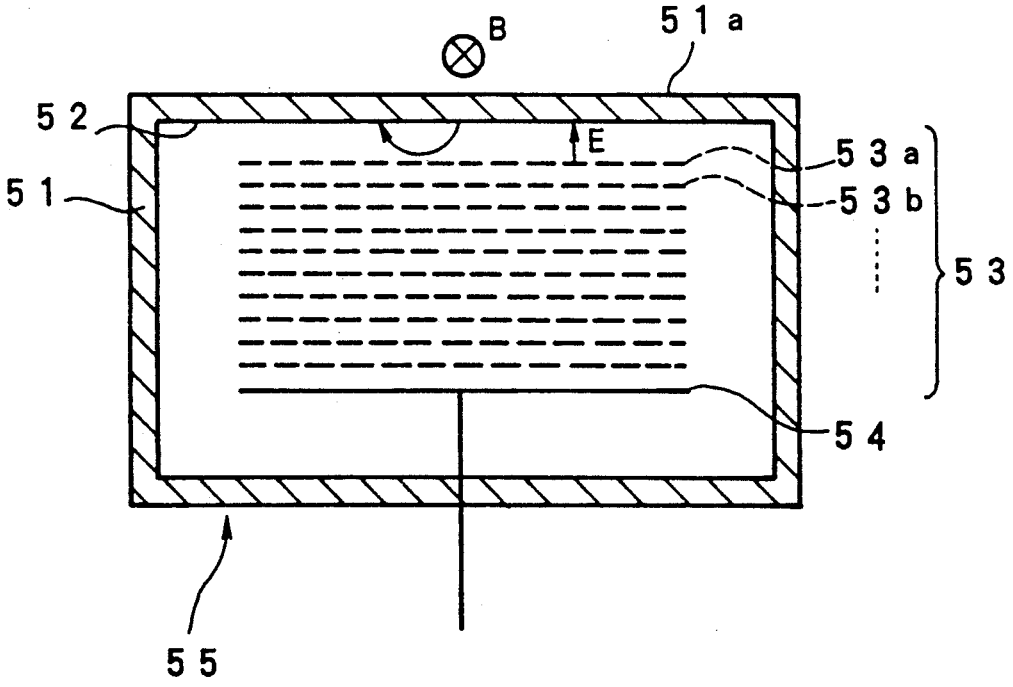
FIG. 2 is a sectional view of the conventional photoelectron multiplying tube showing its structure.
Figure 3:
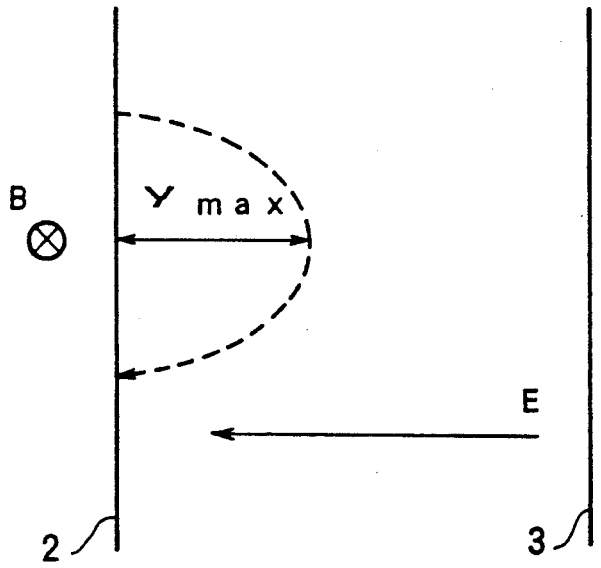
FIG. 3 is a view of a cycloidal motion of the electrons in the conventional phototube and photoelectron multiplying tube.
Figure 4:
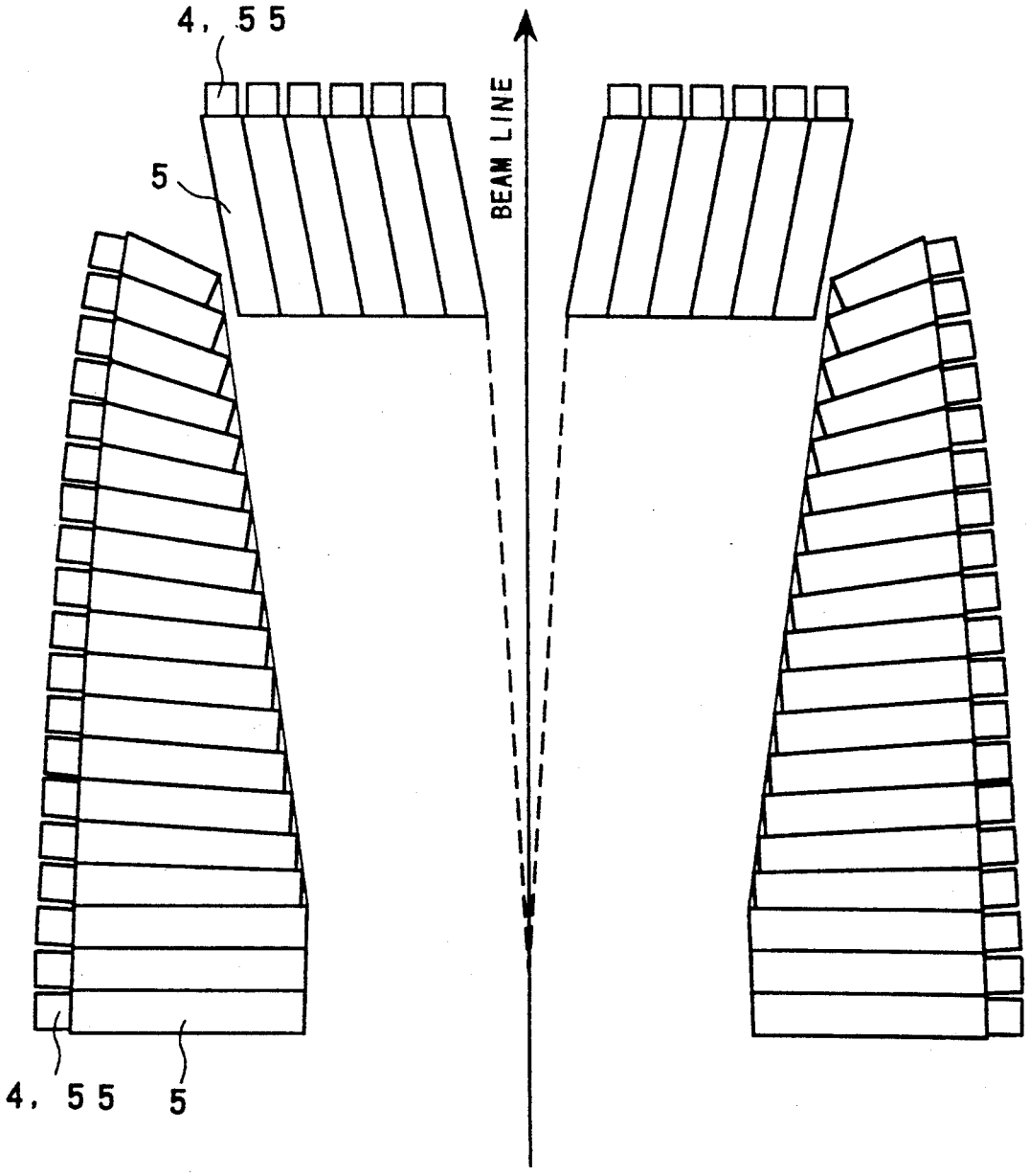
FIG. 4 is a view of the general structure of radiation detecting devices.
Figure 6A:
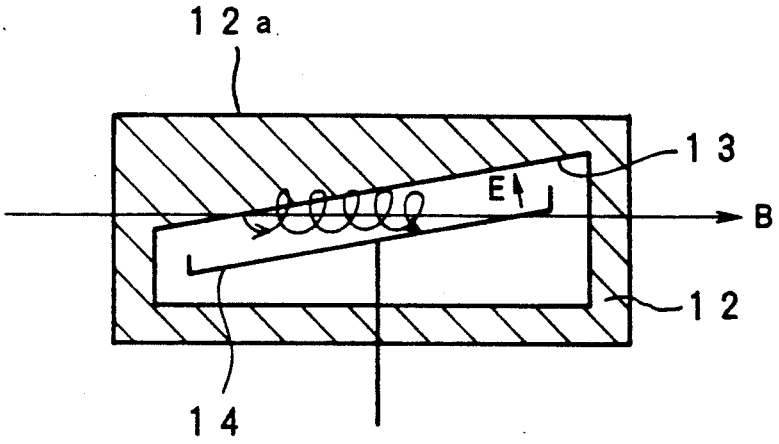
FIGS. 6A and 6B are views of a track photoelectrons have when a magnetic field B is applied at an angle to the photo-electric surface of the phototube of FIG. 5.
Figure 6B:
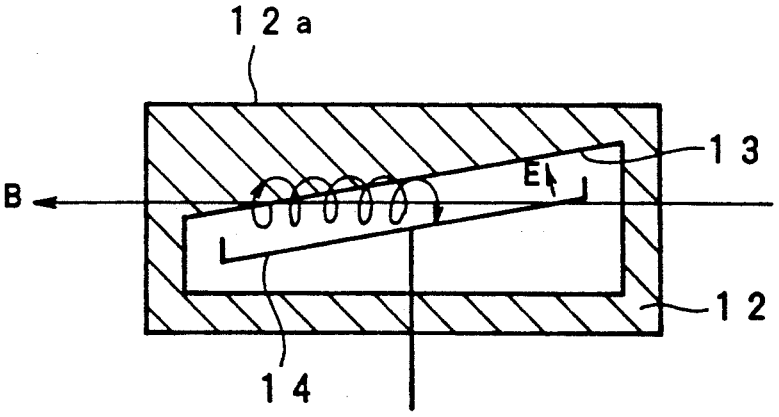

In the phototube 11 according to this embodiment, even when an external magnetic field B is applied in parallelism with the light incident surface 12*a*, most of the photoelectrons emitted by the photocathode 13 are captured by the anode 14 because the photocathode 13 and the anode 14 are inclined to the light incident surface 12*a*. That is, as shown in FIGS. 6A and 6B, in the case that a direction of the magnetic field B has an angle to the photo-electric surface with the photocathode 13 formed on, the photoelectrons emitted by the photocathode 13 move along the direction of the magnetic field B, performing a cycloidal motion because of a component of the electric field E along the direction of the magnetic field, and finally arrive at the anode 14. The magnetic field B in FIG. 6A is directed from the left to the right as viewed in FIG. 6A, and that in FIG. 6B is directed from the right to the left as viewed in FIG. 6B. Irrespective of the direction of the magnetic field B, as long as the magnetic field B and the photoelectric surface form an angle to each other, the photoelectrons emitted by the photocathode 13 are guided to the anode 14. FIGS. 6A and 6B have common reference numerals with FIG. 1 for common members not to repeat their explanation.

Figure 7A:
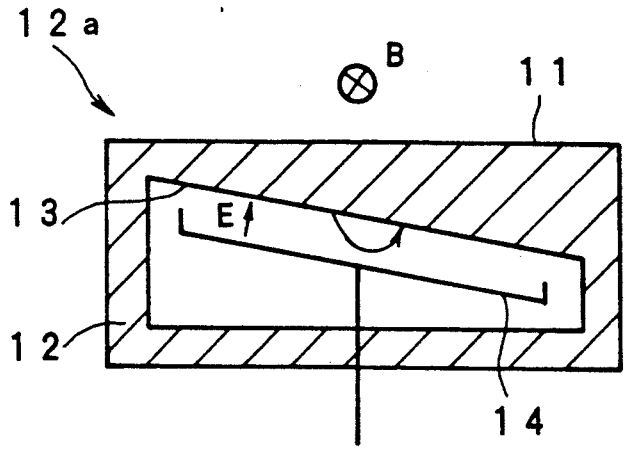
FIGS. 7A and 7B are views of a track photoelectrons have when a magnetic field B is applied without an angle to the photo-electric surface of the phototube of FIG. 5.
Figure 7B:
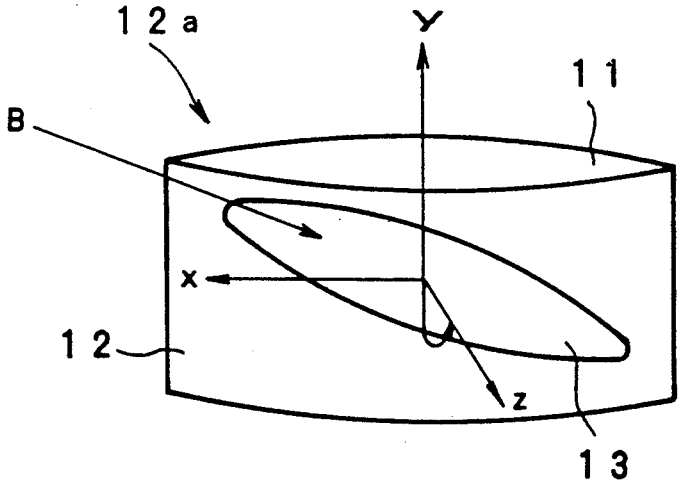

FIGS. 7A and 7B shows the case of the phototube according to the first embodiment that a direction of the external magnetic field B forms no angle to the photoelectric surface. FIGS. 7A and 7B have common reference numerals with FIG. 1 for common members not to repeat their explanation.

In FIG. 7A, a direction of the magnetic field B is vertical as viewed in FIG. 7A and is perpendicular to the electric field E generated between the photocathode 13 and the anode 14. In this case, although the photo-electric surface provided by the photocathode 13 is inclined to a light incident surface 12*a* of the face plate, the photoelectrons emitted b the photocathode 13 take a track indicated by the arrow which returns to the photo-electric surface. In this case, the phototube 11 itself is turned on an axis normal to the light incident surface 12*a*, so that the photo-electric surface form an angle to the magnetic field B. Consequently, similarly with the case of FIG. 6, the photoelectrons emitted by the photocathode 13 move along the direction of the magnetic field B because of a component of the electric field E along the direction of the magnetic field B to arrive at the anode 14.

FIG. 7B is the case that the direction of the magnetic field B is parallel with the photo-electric surface and forms no angle to the photo-electric surface. A photoelectron emitted by the photo-electric surface, when a three dimensional coordinate system with the position where the photoelectron was emitted set at the origin of the coordinate system, have a cycloidal motion in the z-axis direction indicated by the arrow, and adversely returns to the photocathode 13. In this case, the phototube 11 itself is turned on the central axis so that the photo-electric surface has an angle to the direction of the magnetic field B. And the photoelectron can be guided to the anode 14.

Thus, according to the above-described first embodiment, even when the magnetic field B is applied in parallelism with the light incident surface, most of the photoelectrons emitted by the photocathode 13 are captured by the anode 14. Consequently the photodetecting efficiency of the phototube 11 is not lowered by the influence of the external magnetic field B, as has been conventionally. In a radiation detecting device comprising the phototube 11 according to this embodiment and an scintillator, the phototube 11 is merely turned for the prevention of decreases of the radiation detecting efficiency. In other words, radiation detecting devices having good detecting efficiency can be prepared without machining the scintillator in special forms.

Figure 8A:
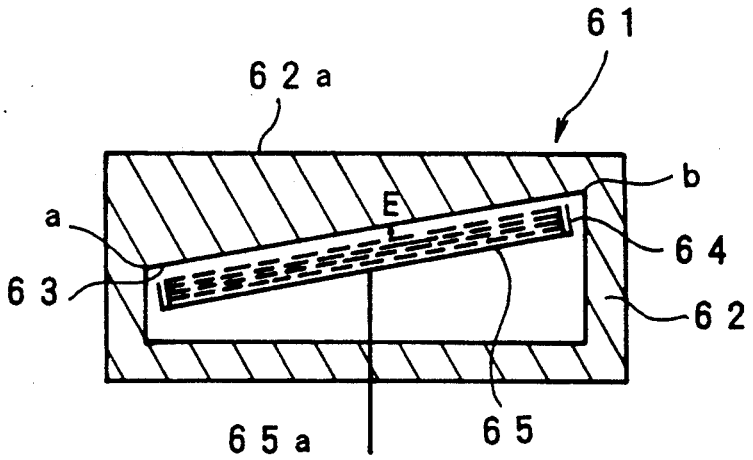
FIGS. 8A and 8B are sectional views of the photoelectron multiplying tube according to a second embodiment of this invention showing its structure.
Figure 8B:
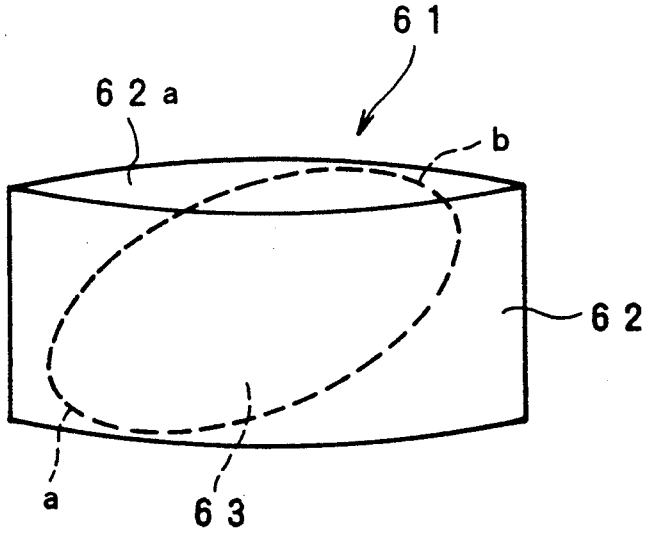

FIG. 8B is a sectional view of the photoelectron multiplying tube according to a second embodiment of this invention, and FIG. 8B is a perspective of the photoelectron multiplying device.

A photoelectron multiplying tube 61 is housed in a cylindrical glass bulb 62. This glass bulb is air-tightly closed at the top surface and the bottom surface to maintain the interior vacuum. This glass bulb 62 is made of a transparent material, and the top surface is the light incident surface 62*a*. Thus a light permeable container is formed. On the inside surface of the glass bulb 62 there is formed a photocathode 63 for emitting photoelectrons when irradiated with a beam of light. A secondary electron multiplying portion 64, for emitting secondary electrons when the photoelectrons emitted by the photocathode 63 impinge thereon is opposed to and near the photocathode 63 in the glass bulb 62. The secondary electron multiplying portion may be, for example, a stacked electrode or a micro channel plate.

Opposed to the secondary photoelectron multiplying portion 64 there is provided an anode 65 for capturing the emitted secondary electrons. The photocathode 63 is formed on an inside surface of the glass bulb 62 inclined at an angle to the light incident surface of the glass bulb 62. The photo-electric surface with the photocathode 63 formed on is indicated by the dot line in the perspective view of FIG. 8B. The end a of the photo-electric surface is most distant from the light incident surface 62*a*, and the end b thereof is nearest to the light incident surface of the incidence 62*a*. The secondary electron multiplying portion 64 and the anode 65 are parallel with the inclined photocathode 63, and a lead 65*a* is provided on the anode 65 and electrically connected to the outside of the glass bulb 62. The anode 65 and the photocathode 63 are sufficiently adjacent to each other to necessitate no electrostatic focusing.

In this structure, the light from the light incident surface 62*a* is incident on the photocathode 63, and is converted there to photoelectrons. The emitted photoelectrons are attracted to the side of the secondary electron multiplying portion 6 because of the electric field E generated between the photocathode 63 and the secondary electron multiplying portion 64 to enter the inside electrode portion from the photoelectron incident surface and secondarily multiplied. Then the multiplied electrons are emitted from the secondary electron emitting part of the secondary electron multiplying portion 64 to enter the photoelectron capturing surface of the anode 65.

Figure 9A:
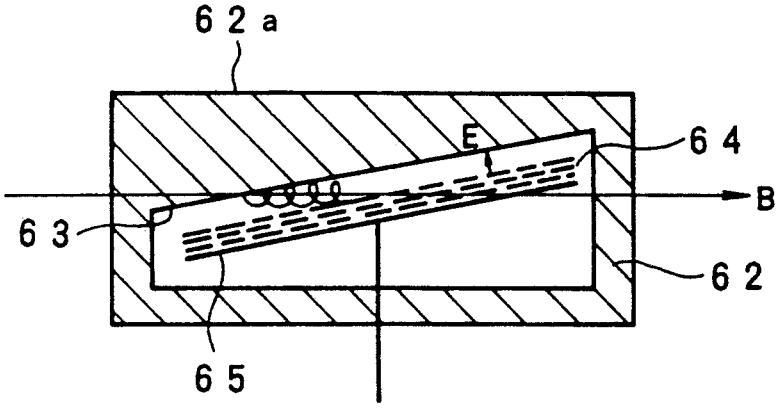
FIGS. 9A and 9B are views of a track photoelectrons have when a magnetic field B is applied at an angle to the photo-electric surface of the photoelectron multiplying tube of FIG. 8.
Figure 9B:
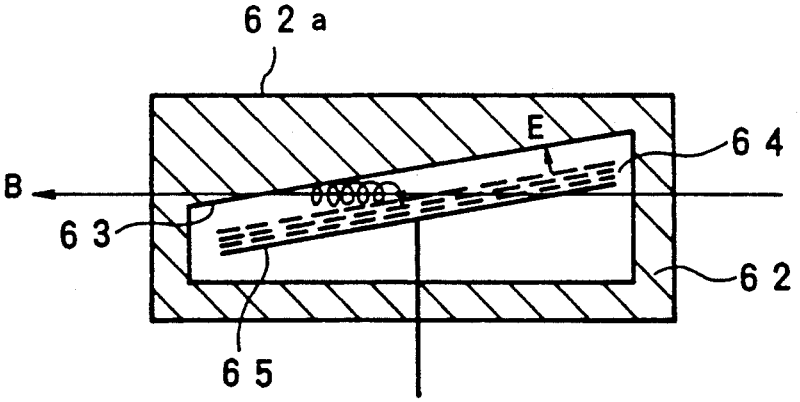

Also in the photoelectron multiplying tube 61 according to this embodiment, even when an external magnetic field B is applied in parallelism with the light incident surface 62*a*, most photoelectrons emitted by the photocathode 63 are captured by the secondary electron multiplying portion 64 because the photocathode 63 and the secondary electron multiplying portion 64 are inclined to the light incident surface 62*a*. That is, as shown in FIGS. 9A and 9B, in the case that a direction of the magnetic field B has an angle to the photoelectric surface with the photocathode 63 formed on, the photoelectrons emitted by the photocathode 63 move along the direction of the magnetic field B in a cycloidal motion due to a component of the electric field E in the direction of the magnetic field finally to reach the secondary electron multiplying portion 64. In FIG. 9A, the magnetic field B is directed from the left to the right in the drawing, and in FIG. 9B the magnetic field B is directed from the right to the left in the drawing. Irrespective of a direction of the magnetic field B, as long as the magnetic field B and the photo-electric surface form an angle to each other, the photoelectrons emitted by the photocathode 63 are guided to the secondary electron multiplying portion 64. In the secondary electron multiplying portion 64 as well, the electrons secondarily emitted by the electrode move along the direction of the magnetic field B in a cycloidal motion finally to reach the anode 65. FIGS. 9A and 9B have reference numerals with FIGS. 7A and 7B for common members not to repeat their explanation.

Figure 10A:
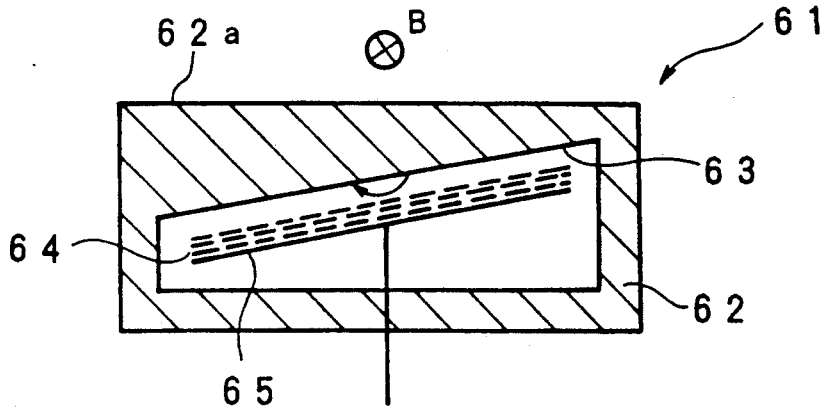
FIGS. 10A and 10B are a views of a track photoelectrons have when a magnetic field B is applied without an angle to the photo-electric surface of the photoelectron multiplying tube.
Figure 10B:
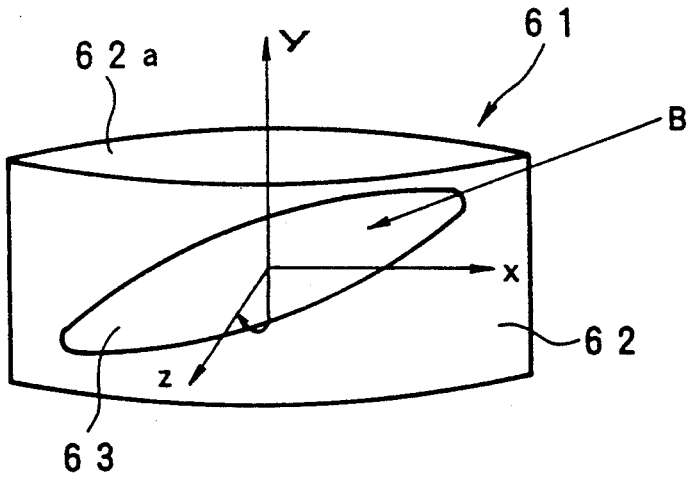

FIGS. 10A and 10B show the photoelectron multiplying tube 61 according the above-described second embodiment in which the external magnetic field B has no angle to the photo-electric surface, and have reference numerals common with FIG. 8 for common members not to repeat their explanation.

In FIG. 10A, a direction of the magnetic field B is vertical in the drawing and is normal to the electric field E generated between the photocathode 63 and the secondary electron multiplying portion 64. In this case, because the direction of the magnetic field B has no angle to the photo-electric surface, the photoelectrons emitted b the photocathode 63 take the track back to the photo-electric surface indicated by the arrow. In this case, the photoelectron multiplying tube 61 itself is turned so that the photo-electric surface has an angle to the magnetic field B. Consequently, similarly with the case of FIGS. 9A and 9B, the photoelectrons emitted by the photocathode 63 move along the direction of the magnetic field B because of a component of the electric field E along the direction of the magnetic field to reach the secondary electron multiplying portion 64. Similarly, electrons secondarily emitted by the secondary electron multiplying portion 64 also move along the direction of the magnetic field B to reach the anode 65.

FIG. 10B shows the case that a direction of the magnetic field B is parallel with the photo-electric surface and has no angle to the latter. In this case, a photoelectron emitted by the photo-electric surface, when a three-dimensional coordinate system is taken with the position where the photoelectron was emitted set at the coordinate origin, has a cycloidal motion directed in the z-axis direction indicated by the arrow and adversely returns to the photo-electric surface. In this case as well as the case described above, the photoelectron multiplying tube 61 itself is turned so that the photo-electric surface has an angle to the magnetic field B. Then the photoelectron is guided to the secondary electron multiplying portion 64, and the multiplied electrons are guided to the anode 65.

Thus, according to the second embodiment, even when the magnetic field B is applied in parallelism with the light incident surface 62*a*, most of the photoelectrons emitted by the photocathode 63 are captured by the secondary electron multiplying portion 64, and the multiplied electrons are captured by the anode 65. Consequently the photodetecting efficiency of the photoelectron multiplying tube 61 is not lowered by the influence of an external magnetic field B, as has been conventionally. Also in the case that a radiation detecting device comprises the photoelectron multiplying tube 61 according to this embodiment and a scintillator, the photoelectron multiplying tube 61 is turned so that a direction of the magnetic field B has an angle to the photocathode 63, for the prevention of decreases of the radiation detecting efficiency.

Figure 11:
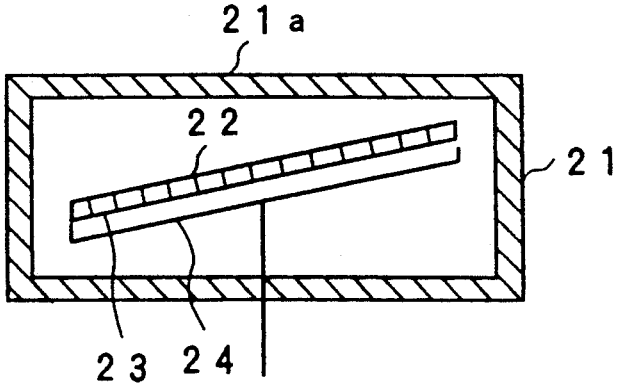
FIG. 11 is a sectional view of the phototube according to a third embodiment of this invention showing its structure.
Figure 12:
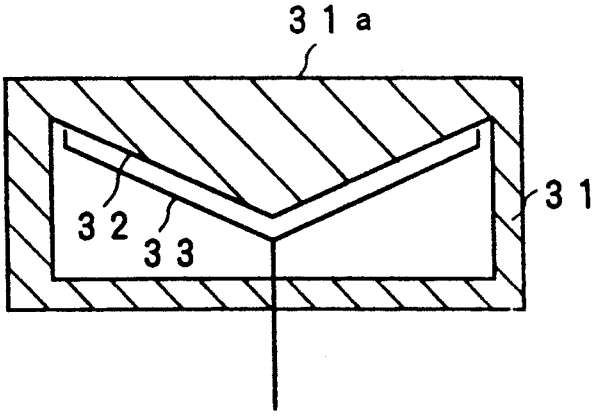
FIG. 12 is a sectional view of the phototube according to a fourth embodiment of this invention showing its structure.
Figure 13:
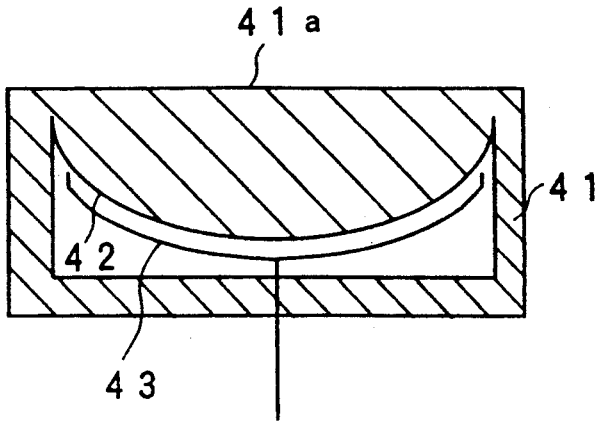
FIG. 13 is a sectional view of the phototube according to a fifth embodiment of this invention.

In each of the phototubes of FIGS. 11, 12 and 13, a photocathode 23, 32, 42 is inclined to the light incident surface 21*a*, 31*a*, 41*a* of the glass bulb. An anode 24, 33, 43 is opposed to the inclined photocathode. Consequently, even when a magnetic field B is applied in parallelism with the light incident surface 21*a*, 31*a*, 41*a* of the glass bulb, similarly with the above-described embodiments, the photoelectrons emitted by the photocathode 23, 32, 42 move along a direction of the magnetic field B because of a component of the electric field E in the direction of the magnetic field B and reach the anode 24, 33, 43. Accordingly these embodiments can achieve the same advantageous effect as the above-described embodiments and can be combined with scintillators to provide radiation detecting devices having improved radiation detecting efficiency.

Figure 14:
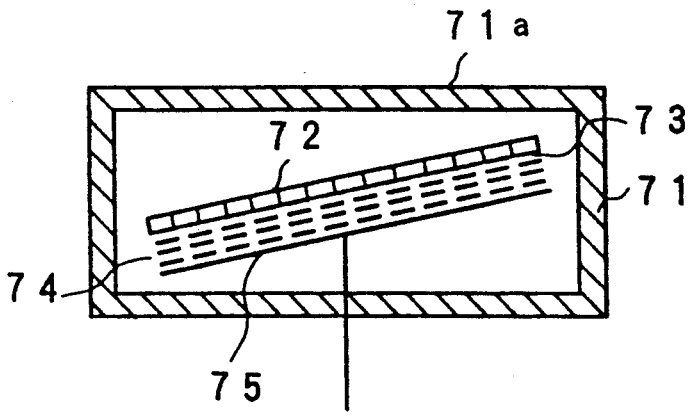
FIG. 14 is a sectional view of the photoelectron multiplying tube according to a sixth embodiment of this invention showing its structure.
Figure 15:
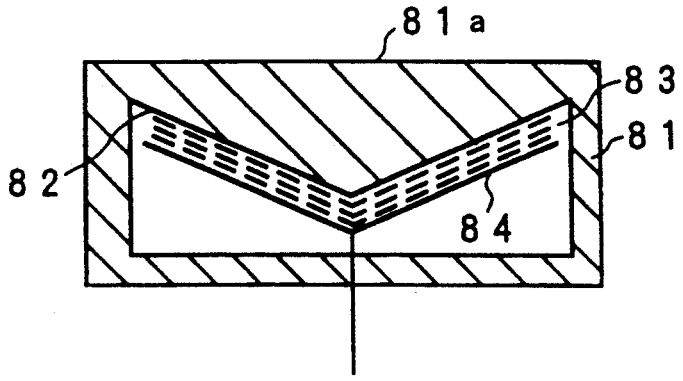
FIG. 15 is a sectional view of the photoelectron multiplying tube according to seventh embodiment of this invention.
Figure 16:
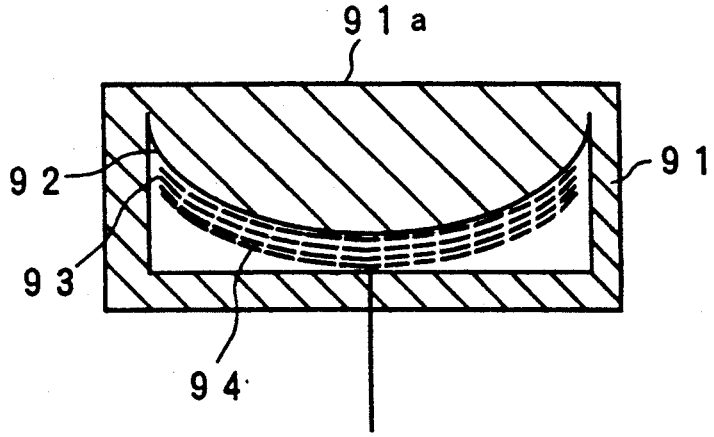
FIG. 16 is a sectional view of the photoelectron multiplying tube according to an eighth embodiment of this invention.

FIGS. 14, 15 and 16 are sectional views of photoelectron multiplying tubes according to a sixth, a seventh and an eighth embodiments of this invention.

The photoelectron multiplying tube of FIG. 14 includes a light incident surface 71*a* on the inside surface of a glass bulb 71, and a separate inclined glass sheet 72. A photocathode 73 is formed on one side of the glass sheet 72 and is inclined to the light incident surface 71*a*. A secondary electron multiplying portion 74 is opposed to the photo-electric surface with the photocathode 73 formed on in parallelism therewith. An anode 75 is opposed to the secondary electron multiplying portion 74 in parallelism therewith.

Figure 17:
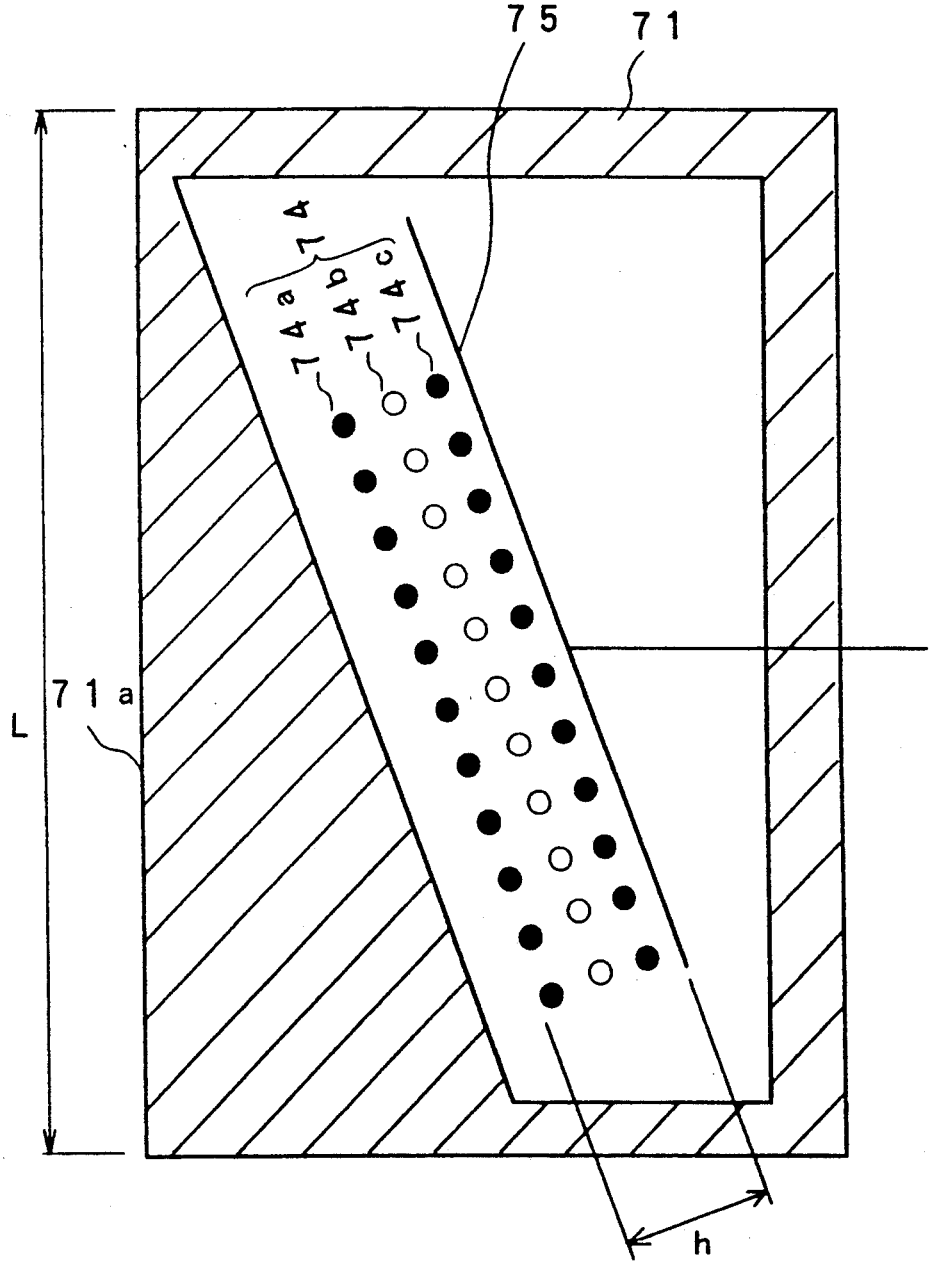
FIG. 17 is a sectional view of a secondary electron multiplying portion of the photoelectron multiplying tube according to the sixth embodiment of FIG. 14 showing its structure in detail.
Figure 18:
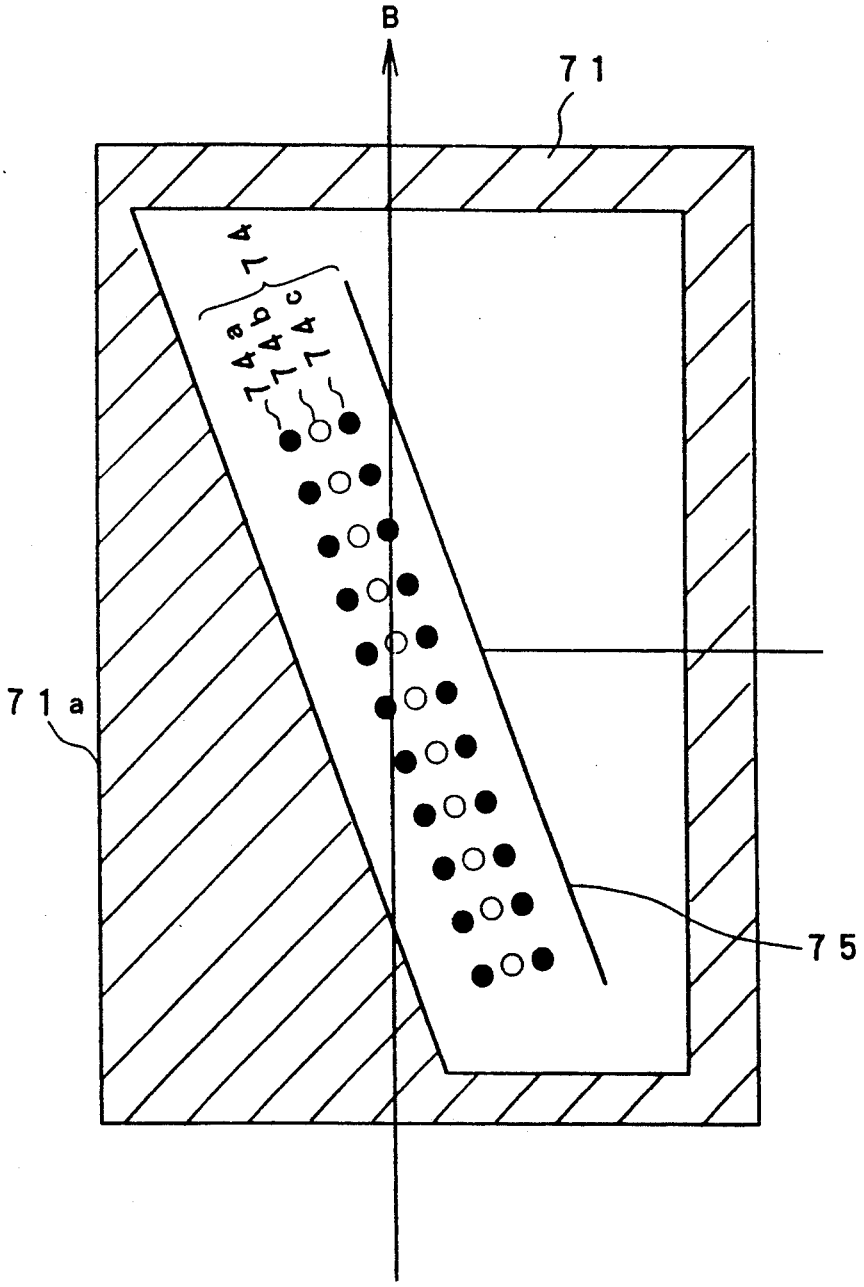

FIG. 17 is a sectional view of the secondary electron multiplying portion 74 detailing it structure. For the simplification of its explanation, the glass sheet 72 is omitted. FIG. 17 has reference numerals common with FIG. 14 for common members not to repeat their explanation. As shown in FIG. 17, the secondary electron multiplying portion 74 comprises three-stage dynodes 74*a*~*c* which emit secondary electrons. Here it is assumed that a bore of the glass bulb 71 is L, and a thickness of the secondary electron multiplying portion 74 is h. FIG. 18 shows a state in which a strong magnetic field B is applied to the secondary electron multiplying portion 74 from the left to the right in the drawing. The photoelectrons emitted by the photocathode 73 on the glass sheet 72 not shown move because of the strong magnetic field B on the same principle as in FIG. 9 and impinge on the dynodes 74*a*. The dynodes 74*a* emit secondary electrons when the photoelectrons impinge thereon, and the secondary electrons secondarily emitted by the dynodes 74*a* are further secondarily multiplied by the dynodes 74*b*, 74*c*. The thus-multiplied electrons move along a direction of the strong magnetic field B in a cycloidal motion toward the side of the anode 75 to be finally captured by the anode 75.

Figure 19:
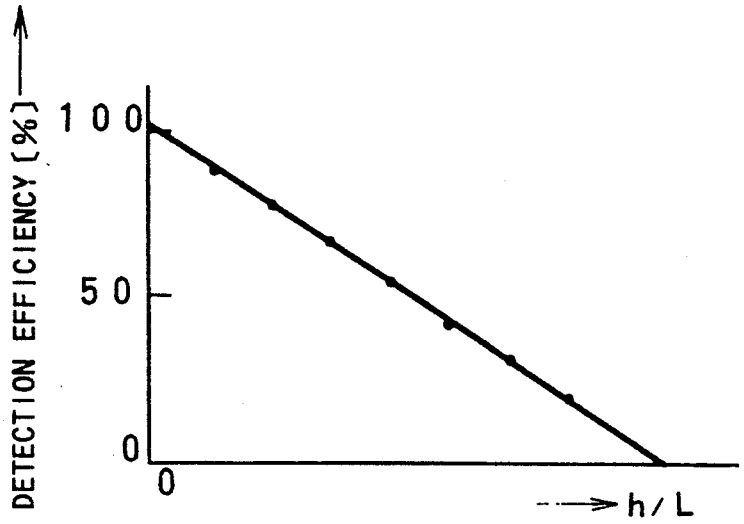
FIG. 19 is a graph of the photodetecting efficiency of the photoelectron multiplying tube according to the six embodiment of FIG. 14.

In such photoelectron multiplying tubes, it is preferable that the thickness h of the secondary electron multiplying portion 74 is sufficiently thin with respect to the bore L of the glass bulb 71. FIG. 19 is a graph of the relationship between ratios h/L (on the horizontal axis) of bores L to thicknesses h, and the photodetecting efficiency (on the vertical axis: %). As seen from the graph, the higher the photodetecting efficiency is, the smaller the ratio is.

The photoelectron multiplying tube of FIG. 15 has the inside surface of a light incident surface 81*a* of a glass bulb 81 of triangular section with the light incident surface 81*a* as the bottom side. A photocathode 82 is formed on the sides other than the bottom side. A secondary electron multiplying portion 82 is opposed to the photo-electric surface with the photocathode 82 formed on in a V-shape contour to the triangular section. An anode 84 is opposed to the secondary electron multiplying portion 83. The photoelectron multiplying tube of FIG. 16 has the inside surface of the light incident surface 91*a* of a glass bulb 92 of substantially semi-circular section. A photocathode 92 is formed on the periphery of the light incident surface of substantially semi-circular section. A secondary electron multiplying portion 93 and an anode 94 are opposed to the periphery of substantially semi-circle contour to the section.

In each of the phototubes of FIGS. 14 to 16, the photocathode 73, 82, 92 is inclined to the light incident surface 71*a*, 81*a*, 91*a* of the glass bulb. The secondary electron multiplying portion 74, 83, 93 is opposed and near to the photocathode 73, 82, 92. Consequently when a magnetic field B is applied in parallelism with the light incident surface 71*a*, 81*a*, 91*a* of the glass bulb, the photoelectrons emitted by the photocathode 73, 82, 92 move along a direction of the magnetic field B because of a component of the electric field E in the direction of the magnetic field B on the same principle as in FIGS. 9A and 9B to reach the secondary electron multiplying portion 74, 83, 93. Similarly the secondarily multiplied electrons also move in the direction of the magnetic field B to reach the anode 75, 84, 94. These embodiments can achieve the same advantageous effect as the above-described embodiments, and are combined with scintillators to provide radiation detecting devices having improved radiation detecting efficiency.

Figure 20:
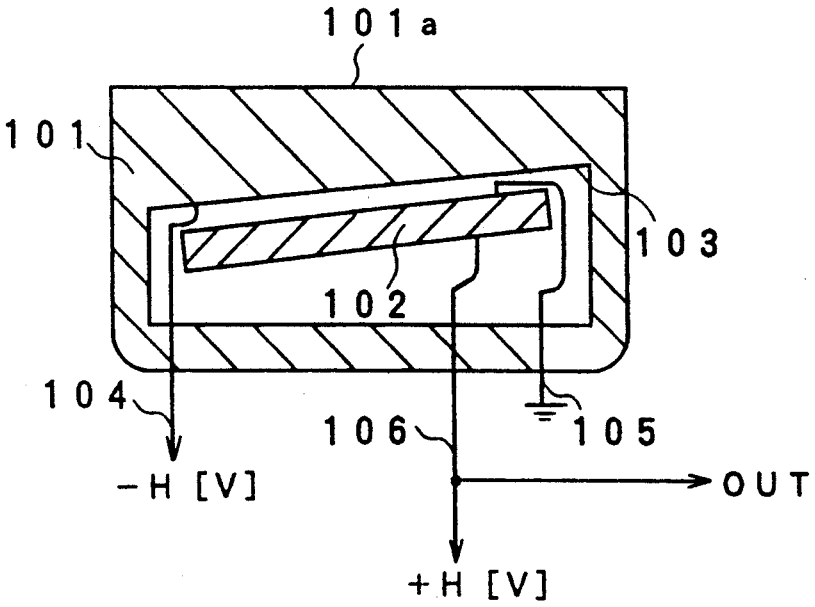
FIG. 20 is a sectional view of the photoelectron multiplying tube according to the ninth embodiment showing its structure.

FIG. 20 is a sectional view of the photoelectron multiplying tube according to a ninth embodiment of this invention.

The photoelectron multiplying tube is accommodated in a glass bulb 101. In the interior of the glass bulb maintained vacuum there is provided a silicon photodiode 102, a solid-state semiconductor device. Inside the glass bulb 101 a photocathode 103 for emitting photoelectrons when irradiated with a beam of light is inclined to a light incident surface 101*a*. The silicon photodiode 102 is opposed to the photocathode 103 near and in parallelism with the same. The photocathode 103 is supplied with a negative high voltage −H[V] through a lead 104, and the photoelectron incident surface of the silicon photodiode 102 is grounded at the earth voltage. A positive high voltage +H[V] is applied to the rear side of the silicon photodiode 102 through a lead 106. This lead 106 is a lead (OUT) for taking out a signal.

In this structure, a beam of light from the light incident surface 101*a* collide against the photocathode 103, and is converted into photoelectrons at the photocathode 103. The emitted photoelectrons are attracted to the side of the photodiode 102 because of the electric field E generated between the photocathode 103 and the silicon photodiode 102. Then the photoelectrons enter at the electron incident surface to be captured by the same. The photoelectrons which have entered the photodiode 102 are electron-multiplied there and are taken outside as a photoelectric current through the lead 106.

Also in the photoelectron multiplying tube according to this embodiment, even when an external magnetic field B is applied in parallelism with the light incident surface 101*a*, most of the photoelectrons emitted by the photocathode 103 enter the photodiode 102 because the photocathode 103 and the photodiode 102 are inclined to the light incident surface 101*a*. Accordingly this embodiment can produce the same advantageous effect as the above-described embodiments. Furthermore in this embodiment, the influence of the external magnetic field does not range to the interior of the photodiode 102, and the influence of the external magnetic field is limited between the photocathode 103 and the exterior of the photodiode 102. The photoelectrons in this space are led to the photodiode 102 as described above. Consequently a photoelectron multiplying tube which is operative even in strong magnetic fields can be provided. Similarly with the above-described embodiments, this embodiment can be combined with a scintillator to provide a radiation detecting device having good radiation detecting efficiency.

As described above, in the phototube according to this invention, even when a magnetic field is applied in parallelism with the light incident surface of the light permeable closed container, the photoelectrons emitted by the photocathode move along a direction of the magnetic field because of a component of the electric field along the direction of the magnetic field when the direction of the magnetic field has an angle to the photo-electric surface with the photocathode formed on. This is due to that the photocathode and the anode are inclined to the light incident surface.

Also in the phototube in which photoelectrons are secondarily multiplied, and the phototube in which photoelectrons are multiplied internally in the solid-state semiconductor device, even when a magnetic field is applied in parallelism with the light incident surface of the light permeable closed container, the photoelectrons emitted by the photocathode move along a direction of the magnetic field because of a component of the electric field in the direction of the magnetic field to reach the electrode and the solid-state semiconductor device for emitting the secondary electrons.

Consequently in each of the above described phototubes, the photoelectrons emitted by the photocathode can be captured by the anode, and the electrode and the solid-state semiconductor device for emitting secondary electrons, and the photodetecting efficiency of the phototubes are maintained good.

The electrons secondarily emitted also move along the direction of the external magnetic field to be captured by the anode opposed to the electrode. Consequently the photoelectrons can be secondarily multiplied without the influence of the external strong magnetic field, and a sufficient number of electrons can captured by the anode. In the interior of the solid-state semiconductor device, the photoelectrons which have entered the same can be multiplied without the influence of the external magnetic field. Consequently the photoelectron multiplying tube can perform electron multiplication without the influence of the external magnetic field.

Furthermore, the phototubes, and the photoelectron multiplying tube can be applied to radiation detecting devices, and such radiation detecting devices have good radiation detecting efficiency.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

We claim:

1. A phototube comprising:

a closed container having a light permeable face plate, wherein the outside of said face plate is a light incident surface;

a photocathode disposed in the closed container so that at least a part of a photo-electric surface is inclined to the light incident surface; and an anode disposed in the closed container so that an electron capturing surface is opposed to the photoelectric surface in parallelism therewith.

2. A phototube according to claim 1, wherein the inside surface of the face plate is formed inclined to the light incident surface; and the photocathode is formed on the inside surface of the face plate.

3. A phototube according claim 1, wherein a light permeable plate which is inclined to the light incident surface is provided in the closed container; and the photocathode is formed on the light permeable plate.

4. A radiation detecting device comprising:

a phototube according to claim 1; and a scintillator provided on or adjacent to the light incident surface of the phototube, the scintillator emitting light when exposed to radiation.

5. A radiation detecting device according to claim 4, wherein the scintillator is rotatable on an axial line which is perpendicular to the light incident surface and passes the center of the light incident surface.

6. A photoelectron multiplying tube comprising:

a closed container having a light permeable face plate, wherein the outside surface of said face plate is a light incident surface;

a photocathode disposed in the closed container so that at least a part of a photo-electric surface disposed inclined to the light incident surface;

secondary electron multiplying means disposed in the closed container so that a photoelectron incident surface is opposed to the photo-electric surface in parallelism therewith; and an anode disposed in the closed container so that an electron capturing surface is opposed to a secondary electron emitting surface of the secondary electron multiplying means in parallelism therewith.

7. A photoelectron multiplying tube according to claim 6, wherein the inside surface of the face plate is formed inclined to the light incident surface; and the photocathode is formed on the inside surface of the face plate.

8. A photoelectron multiplying tube according to claim 6, wherein a light permeable plate which is inclined to the light indent surface is provided in the closed container; and the photocathode is formed on the light permeable plate.

9. A photoelectron multiplying tube according to claim 6, wherein an electrode portion of the secondary electron emitting means has a thickness smaller than a diameter of the closed container.

10. A radiation detecting device comprising:

a photoelectron multiplying tube according to claim 6; and a scintillator provided on or adjacent to the light incident surface of the photoelectron multiplying tube, the scintillator emitting light when exposed to radiation.

11. A radiation detecting device according to claim 10, wherein the scintillator is rotatable on an axial line which is perpendicular to the light incident surface and passes the center thereof.

12. A phototube comprising:

a closed container having a face plate, wherein the outside surface of said face plate is a light incident surface;

a photocathode disposed in the closed container so that at least a part of a photo-electric surface is inclined to the light incident surface in parallelism therewith: and a solid-state semiconductor device disposed in the closed container so that an electron incident surface is opposed to the photo-electric surface in parallelism therewith.

13. A phototube according to claim 12, wherein the inside surface of the face plate is formed inclined to the light incident surface; and the photocathode is formed on the inside surface of the face plate.

14. A phototube according to claim 12, wherein a light permeable plate which is inclined to the light incident surface is provided in the closed container; and the photocathode is formed on the light permeable plate.

15. A phototube according to claim 12, wherein the solid-state semiconductor internally multiplies the photoelectrons incident thereon.

16. A radiation detecting device comprising:

a phototube according to claim 12;

a scintillator provided on or adjacent to the light incident surface of the phototube, the scintillator emitting light when exposed to radiation.

17. A radiation detecting device according to claim 16, wherein the scintillator is rotatable on an axial line which is perpendicular to the light incident surface and passes the center thereof.

* * * * *